US009330538B2

(12) United States Patent
Konstakis et al.

(10) Patent No.: US 9,330,538 B2
(45) Date of Patent: May 3, 2016

(54) METHODS AND SYSTEMS FOR CONDUCTING GAMES OF CHANCE

(71) Applicant: Intralot S.A.—Integrated Lottery Systems and Services, Athens (GR)

(72) Inventors: Nikolaos Konstakis, Athens (GR); Nikolaos Kapatos, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 0 days.

(21) Appl. No.: 13/935,996

(22) Filed: Jul. 5, 2013

(65) Prior Publication Data

US 2014/0011560 A1 Jan. 9, 2014

Related U.S. Application Data

(60) Provisional application No. 61/668,306, filed on Jul. 5, 2012.

(51) Int. Cl.
*G07F 17/32* (2006.01)

(52) U.S. Cl.
CPC ..... *G07F 17/329* (2013.01); *G07F 17/326* (2013.01); *G07F 17/3288* (2013.01)

(58) Field of Classification Search
CPC .. G07F 17/3288; G07F 17/326; G07F 17/329
USPC ..... 463/16–17
See application file for complete search history.

(56) References Cited

U.S. PATENT DOCUMENTS

| | | | | |
|---|---|---|---|---|
| 5,575,474 | A * | 11/1996 | Rossides | 463/26 |
| 5,722,890 | A * | 3/1998 | Libby et al. | 463/17 |
| 2002/0065566 | A1 * | 5/2002 | Aronson et al. | 700/91 |
| 2002/0155885 | A1 * | 10/2002 | Shvili | 463/25 |
| 2004/0058731 | A1 * | 3/2004 | Rossides | 463/42 |
| 2013/0024342 | A1 * | 1/2013 | Horowitz et al. | 705/35 |

* cited by examiner

*Primary Examiner* — Pierre E Elisca
*Assistant Examiner* — David Duffy
(74) *Attorney, Agent, or Firm* — Greenberg Traurig, LLP

(57) ABSTRACT

A computer-implemented method that includes programming a computer machine to perform the steps of: providing game slips to game players, where each games slip has game options and one of the game options is a first game option that includes a non-verified outcome of an event; receiving the game slips that include selected game options where one selected game option includes the first game option; determining odds of the first game option based on: 1-P, where P is the probability of a verified outcome of the event, a financial criterion of the game provider, and the selected game options; providing and receiving acceptance of the odds; determining whether the event has resulted in the verified outcome or the non-verified outcome; and determining, for each game player that selected the first game option, a prize based on the accepted odds when the event results in a non-verified outcome.

16 Claims, 12 Drawing Sheets

| LEAGUE | KICK OFF TIME | CODE | S/S | HOME TEAM | | 1 | X | 2 | | AWAY TEAM | HANDICAP | HALF TIME | | | TOTAL GOALS | | |
|---|---|---|---|---|---|---|---|---|---|---|---|---|---|---|---|---|---|
| | | | | | | | | | | | | 1 | X | 2 | 0-1 | 2-3 | 4+ |
| **WEDNESDAY 1 FEBRUARY 2012** | | | | | | | | | | | | | | | | | |
| EPL | 22:00 | 583 | 1 | BLACKBURN | 18 | 2,60 | 3,20 | 2,60 | 6 | NEWCASTLE | | 3,20 | 2,05 | 3,20 | 3,30 | 1,90 | 2,70 |
| | | 584 | 1 | BOLTON | 17 | 5,00 | 3,60 | 1,65 | 5 | ARSENAL | | 5,00 | 2,40 | 2,15 | 4,25 | 1,90 | 2,25 |
| | | 585 | 1 | FULHAM | 12 | 1,80 | 3,40 | 4,25 | 15 | WEST BROM | | 2,40 | 2,15 | 4,60 | 3,20 | 1,85 | 2,85 |
| | | 586 | 1 | SUNDERLAND | 10 | 1,85 | 3,40 | 4,00 | 9 | NORWICH | | 2,50 | 2,15 | 4,50 | 3,30 | 1,85 | 2,75 |

*FIG. 3*

EC 020 WINNER

| CODES | TEAMS | ODDS |
|---|---|---|
| 0101 | SPAIN | 10,00 |
| 0102 | ENGLAND | 5,50 |
| 0103 | BRAZIL | 3,50 |
| 0104 | ARGENTINA | 7,00 |
| 0105 | GERMANY | 15,00 |
| 0112 | NETHERLANDS | 12,00 |
| 0113 | ITALY | 12,00 |
| 0114 | FRANCE | 15,00 |
| 0115 | IVORY COAST | 25,00 |
| 0123 | PORTUGAL | 25,00 |
| 0124 | CHILE | 60,00 |
| 0125 | PARAGUAY | 75,00 |
| 0134 | GHANA | 60,00 |
| 0135 | SERBIA | 60,00 |
| 0145 | CAMEROON | 75,00 |
| 0201 | DENMARK | 150,00 |
| 0202 | MEXICO | 75,00 |
| 0203 | NIGERIA | 100,00 |
| 0204 | URUGUAY | 100,00 |
| 0205 | USA | 75,00 |
| 0212 | AUSTRALIA | 150,00 |
| 0213 | GREECE | 150,00 |
| 0214 | S. AFRICA | 100,00 |
| 0215 | S. KOREA | 150,00 |
| 0223 | ALGERIA | 500,00 |
| 0224 | JAPAN | 500,00 |
| 0225 | SLOVENIA | 250,00 |
| 0234 | SWITZERLAND | 250,00 |
| 0235 | SLOVAKIA | 250,00 |
| 0245 | HONDURAS | 750,00 |
| 0301 | N. KOREA | 750,00 |
| 0302 | NEW ZEALAND | 750,00 |

EC 020 WORLD CUP 2010 WINNER 07-05-2010 21:00

| | | | |
|---|---|---|---|
| SPAIN | 10,00 | MEXICO | 75,00 |
| ENGLAND | 5,50 | NIGERIA | 100,00 |
| BRAZIL | 3,50 | URUGUAY | 100,00 |
| ARGENTINA | 7,00 | USA | 75,00 |
| GERMANY | 15,00 | AUSTRALIA | 150,00 |
| NETHERLANDS | 12,00 | GREECE | 150,00 |
| ITALY | 12,00 | S. AFRICA | 100,00 |
| FRANCE | 15,00 | S. KOREA | 150,00 |
| IVORY COAST | 25,00 | ALGERIA | 500,00 |
| PORTUGAL | 25,00 | JAPAN | 500,00 |
| CHILE | 60,00 | SLOVENIA | 250,00 |
| PARAGUAY | 75,00 | SWITZERLAND | 250,00 |
| GHANA | 60,00 | SLOVAKIA | 250,00 |
| SERBIA | 60,00 | HONDURAS | 750,00 |
| CAMEROON | 75,00 | N. KOREA | 750,00 |
| DENMARK | 150,00 | NEW ZEALAND | 750,00 |

CONTRA BET MULTICHANCE

*FIG. 5C*

| LEAGUE | K-OFF TIME | CODE | HOME WIN | | | | | | | | | | | | | | | HOME TEAM | DRAW | | | | | AWAY TEAM | AWAY WIN | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|
| | | | 1-0 | 2-0 | 2-1 | 3-0 | 3-1 | 3-2 | 4-0 | 4-1 | 4-2 | 4-3 | 5'-0 | 5'-1 | 5'-2 | 5'-3 | 5'-4 | | 0-0 | 1-1 | 2-2 | 3-3 | 4-4 | | 0-1 | 0-2 | 1-2 | 0-3 | 1-3 | 2-3 | 0-4 | 1-4 | 2-4 | 3-4 | 0-5' | 1-5' | 2-5' | 3-5' | 4-5' |
| **WEDNESDAY 1 FEBRUARY 2012** | | | | | | | | | | | | | | | | | | | | | | | | | | | | | | | | | | | | | | | |
| EPL | 22:00 | 583 | 9,00 | 8,00 | 12,00 | 30,00 | 24,00 | 28,00 | 80,00 | 70,00 | 90,00 | 150,00 | 100,00 | 80,00 | 100,00 | 200,00 | 400,00 | BLACKBURN | 10,00 | 6,25 | 10,00 | 40,00 | 200,00 | NEWCASTLE | 9,00 | 13,00 | 9,50 | 30,00 | 24,00 | 28,00 | 80,00 | 70,00 | 90,00 | 150,00 | 100,00 | 80,00 | 100,00 | 200,00 | 400,00 |
| | | 584 | 18,00 | 26,00 | 16,00 | 60,00 | 50,00 | 50,00 | 200,00 | 200,00 | 150,00 | 200,00 | 200,00 | 200,00 | 200,00 | 300,00 | 500,00 | BOLTON | 13,00 | 6,75 | 13,00 | 60,00 | 200,00 | ARSENAL | 8,00 | 9,00 | 8,00 | 13,00 | 11,00 | 24,00 | 30,00 | 28,00 | 60,00 | 150,00 | 40,00 | 32,00 | 70,00 | 200,00 | 300,00 |
| | | 585 | 7,00 | 8,00 | 8,00 | 15,00 | 14,00 | 24,00 | 45,00 | 40,00 | 70,00 | 150,00 | 60,00 | 50,00 | 70,00 | 200,00 | 500,00 | FULHAM | 9,00 | 6,00 | 16,00 | 70,00 | 200,00 | WEST BROM | 10,00 | 22,00 | 16,00 | 70,00 | 50,00 | 50,00 | 200,00 | 200,00 | 150,00 | 200,00 | 200,00 | 200,00 | 200,00 | 300,00 | 500,00 |
| | | 586 | 7,50 | 9,50 | 8,00 | 18,00 | 16,00 | 24,00 | 50,00 | 45,00 | 70,00 | 150,00 | 60,00 | 50,00 | 70,00 | 200,00 | 500,00 | SUNDERLAND | 9,00 | 6,00 | 16,00 | 70,00 | 200,00 | NORWICH | 11,00 | 22,00 | 14,00 | 60,00 | 40,00 | 45,00 | 150,00 | 150,00 | 150,00 | 200,00 | 200,00 | 200,00 | 200,00 | 400,00 | 500,00 |

FIG. 6

EC 020 WINNER

| CODES | TEAMS | ODDS |
|---|---|---|
| 0101 | SPAIN | 10,00 |
| 0102 | ENGLAND | 5,50 |
| 0103 | BRAZIL | 3,50 |
| 0104 | ARGENTINA | 7,00 |
| 0105 | GERMANY | 15,00 |
| 0112 | NETHERLANDS | 12,00 |
| 0113 | ITALY | 12,00 |
| 0114 | FRANCE | 15,00 |
| 0115 | IVORY COAST | 25,00 |
| 0123 | PORTUGAL | 25,00 |
| 0124 | CHILE | 60,00 |
| 0125 | PARAGUAY | 75,00 |
| 0134 | GHANA | 60,00 |
| 0135 | SERBIA | 60,00 |
| 0145 | CAMEROON | 75,00 |
| 0201 | DENMARK | 150,00 |
| 0202 | MEXICO | 75,00 |
| 0203 | NIGERIA | 100,00 |
| 0204 | URUGUAY | 100,00 |
| 0205 | USA | 75,00 |
| 0212 | AUSTRALIA | 150,00 |
| 0213 | GREECE | 150,00 |
| 0214 | S. AFRICA | 100,00 |
| 0215 | S. KOREA | 150,00 |
| 0223 | ALGERIA | 500,00 |
| 0224 | JAPAN | 500,00 |
| 0225 | SLOVENIA | 250,00 |
| 0234 | SWITZERLAND | 250,00 |
| 0235 | SLOVAKIA | 250,00 |
| 0245 | HONDURAS | 750,00 |
| 0301 | N. KOREA | 750,00 |
| 0302 | NEW ZEALAND | 750,00 |

*FIG. 8A*

METHODS AND SYSTEMS FOR CONDUCTING GAMES OF CHANCE

RELATED APPLICATIONS

This application claims the benefit of U.S. Provisional Application No. 61/668,306, entitled "METHODS AND SYSTEMS FOR CONDUCTING GAMES OF CHANCE," filed Jul. 5, 2012, which is hereby incorporated by reference herein in its entirety for all purposes.

TECHNICAL FIELD

The instant invention relates to methods and systems for playing games of chance.

BACKGROUND

Methods and systems for playing games of chance are known.

SUMMARY OF INVENTION

In some embodiments, the invention is a computer-implemented method that includes specifically programming at least one computer machine to at least perform the following:

In some embodiments, the method includes providing a plurality of game slips to game players, wherein each of the plurality of games slips has a plurality of game options, wherein a first game option of the plurality of game options includes a non-verified outcome of a first event, and wherein the non-verified outcome of the first event is an outcome that will not occur in a future.

In some embodiments, the method includes receiving the plurality of game slips from the game players, wherein the plurality of game slips comprise a plurality of selected game options and wherein at least one of the plurality of selected game options includes the first game option.

In some embodiments, the method includes determining odds of the first game option based, at least in part, on: i) 1-P, wherein P is a probability of a verified outcome of the first event and wherein the verified outcome of the first event is an outcome that will occur in the future; ii) a financial criterion associated with a game provider; and iii) the plurality of selected game options.

In some embodiments, the method includes providing the odds to the game players that selected the first game option.

In some embodiments, the method includes receiving acceptance of the odds from the game players that selected the first game option.

In some embodiments, the method includes determining whether the first event has resulted in the verified outcome or the non-verified outcome.

In some embodiments, the method includes determining, for each game player of the game players that selected the first game option, at least one prize based, at least in part, on the odds accepted by each game player when the first event has resulted in the non-verified outcome. In some embodiments, the game is a lottery game. In some embodiments, the method further includes displaying the plurality of game slips on a computer screen to the game players. In some embodiments, the method further includes distributing the at least one prize to each of the game players that selected the first game option. In some embodiments, the financial criterion associated with the game provider is a profit of the game provider.

In some embodiments, the invention is a computer-implemented method that includes specifically programming at least one computer machine to at least perform the following:

In some embodiments, the method includes providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, and wherein the first game option and the second game option are mutually exclusive.

In some embodiments, the method includes receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the method includes determining odds of the first game option and second game option based, at least in part, on i) P1+P2, wherein P2 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options;

In some embodiments, the method includes providing the odds to the first game player.

In some embodiments, the method includes receiving acceptance of the odds from the first game player.

In some embodiments, the method includes determining a third outcome of the first event, wherein the third outcome is a result of the first event.

In some embodiments, the method includes determining whether the third outcome of the first event matches the first outcome of the first game option or the second outcome of the second game option.

In some embodiments, the method includes determining at least one prize for the first game player based, at least in part, on the odds when the third outcome of the first event matches the first outcome of the first game option or the second outcome of the second game option.

In some embodiments, the game is a lottery game. In some embodiments, the method further includes displaying the plurality of game slips on a computer screen to the game players. In some embodiments, the method further includes distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a non-verified outcome of a first event, and wherein the non-verified outcome of the first event is an outcome that will not occur in a future.

In some embodiments, the program code performs the step of receiving the plurality of game slips from the game players, wherein the plurality of game slips comprise a plurality of selected game options and wherein at least one of the plurality of selected game options includes the first game option.

In some embodiments, the program code performs the step of determining odds of the first game option based, at least in part, on i) 1-P, wherein P is a probability of a verified outcome of the first event and wherein the verified outcome of the first event is an outcome that will occur in the future; ii) a financial criterion associated with a game provider; and iii) the plurality of selected game options.

In some embodiments, the program code performs the step of providing the odds to the game players that selected the first game option.

In some embodiments, the program code performs the step of receiving acceptance of the odds from the game players that selected the first game option.

In some embodiments, the program code performs the step of determining whether the first event has resulted in the verified outcome or the non-verified outcome.

In some embodiments, the program code performs the step of determining, for each game player of the game players that selected the first game option, at least one prize based, at least in part, on the odds accepted by each game player when the first event has resulted in the non-verified outcome.

In some embodiments, the game is a lottery game. In some embodiments, the program code performs: displaying the plurality of game slips on a computer screen to the game players. In some embodiments, the program code performs the step of distributing the at least one prize to each of the game players that selected the first game option. In some embodiments, the financial criterion associated with the game provider is a profit of the game provider.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, and wherein the first game option and the second game option are mutually exclusive.

In some embodiments, the program code performs the step of receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the program code performs the step of determining odds of the first game option and second game option based, at least in part, on i) P1+P2, wherein P2 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the program code performs the step of providing the odds to the first game player.

In some embodiments, the program code performs the step of receiving acceptance of the odds from the first game player.

In some embodiments, the program code performs the step of determining a third outcome of the first event, wherein the third outcome is a result of the first event.

In some embodiments, the program code performs the step of determining whether the third outcome of the first event matches the first outcome of the first game option or the second outcome of the second game option.

In some embodiments, the program code performs the step of determining at least one prize for the first game player based, at least in part, on the odds when the third outcome of the first event matches the first outcome of the first game option or the second outcome of the second game option.

In some embodiments, the game is a lottery game. In some embodiments, the program code performs the step of displaying the plurality of game slips on a computer screen to the game players. In some embodiments, the program code performs the step of distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and wherein the exhaustive market is a market that includes all possible alternative outcomes of the first event.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

FIG. 3 illustrates features of some embodiments of the present invention.

FIG. 5C illustrates features of some embodiments of the present invention.

FIG. 6 illustrates features of some embodiments of the present invention.

FIG. 8A illustrates features of some embodiments of the present invention.

Figure 1:
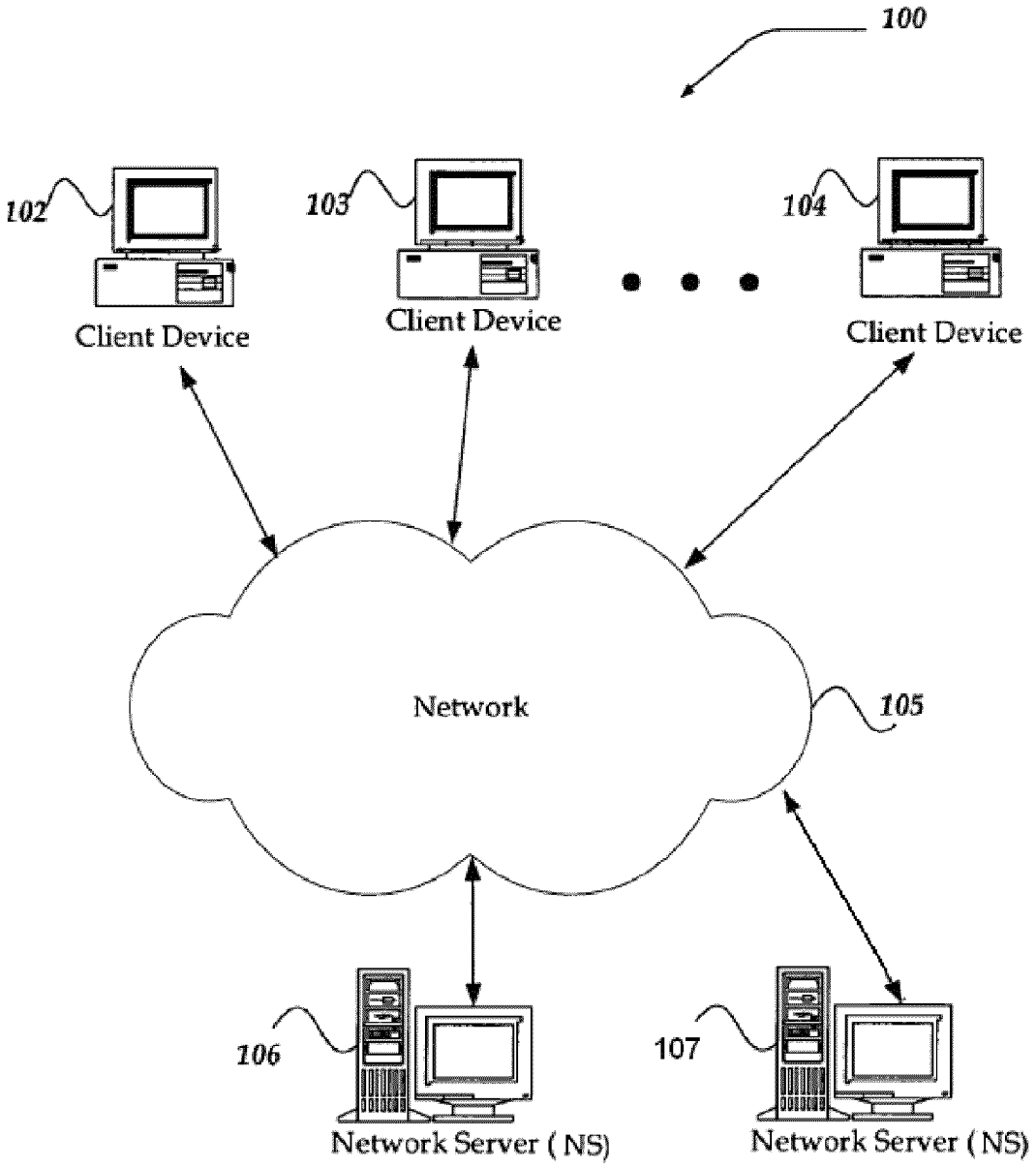
FIG. 1 illustrates features of some embodiments of the present invention.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION

Some of various embodiments of the present invention are described herein as being implemented in lottery games, those embodiments are exemplary and not limiting; and other embodiments of the instant invention can be, for example, implement in casino games, and games offered through betting exchanges.

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Illustrative Operating Environments

FIG. 1 illustrates one embodiment of an environment in which the present invention may operate. However, not all of these components may be required to practice the invention, and variations in the arrangement and type of the components may be made without departing from the spirit or scope of the invention. In some embodiment, the inventive system for conducting a game hosts a large number of members and concurrent transactions. In other embodiments, the inventive system for conducting a game is based on a scalable computer/machine and network architecture that incorporates varies strategies for assessing the data, caching, searching, and database connection pooling. An example of the scalable architecture is an architecture that is capable of operating multiple servers.

In embodiments, members of the inventive computer system 102-104 (e.g. user (e.g. players, agents, etc.) include virtually any computing device capable of receiving and sending a message over a network, such as network 105, to and from another computing device, such as servers 106 and 107, each other, and the like. In embodiments, the set of such devices includes devices that typically connect using a wired communications medium such as personal computers, multiprocessor systems, microprocessor-based or programmable consumer electronics, network PCs, and the like. In embodiments, the set of such devices also includes devices that typically connect using a wireless communications medium such as cell phones, smart phones, pagers, walkie talkies, radio frequency (RF) devices, infrared (IR) devices, CBs, integrated devices combining one or more of the preceding devices, or virtually any mobile device, and the like. Similarly, in embodiments, client devices 102-104 are any device that is capable of connecting using a wired or wireless communication medium such as a PDA, POCKET PC, wearable computer/machine, and any other device that is equipped to communicate over a wired and/or wireless communication medium.

In embodiments, each member device within member devices 102-104 may include a browser application that is configured to receive and to send web pages, and the like. In embodiments, the browser application may be configured to receive and display graphics, text, multimedia, and the like, employing virtually any web based language, including, but not limited to Standard Generalized Markup Language (SMGL), such as HyperText Markup Language (HTML), a wireless application protocol (WAP), a Handheld Device Markup Language (HDML), such as Wireless Markup Language (WML), WMLScript, JavaScript, and the like. In some embodiments, the invention is programmed in either Java or .Net.

In embodiments, member devices 102-104 may be further configured to receive a message from the another computing device employing another mechanism, including, but not limited to email, Short Message Service (SMS), Multimedia Message Service (MMS), instant messaging (IM), internet relay chat (IRC), mIRC, Jabber, and the like.

In embodiments, network 105 may be configured to couple one computing device to another computing device to enable them to communicate. In embodiments, network 105 may be enabled to employ any form of computer readable media for communicating information from one electronic device to another. Also, in embodiments, network 105 may include a wireless interface, and/or a wired interface, such as the Internet, in addition to local area networks (LANs), wide area networks (WANs), direct connections, such as through a universal serial bus (USB) port, other forms of computer-readable media, or any combination thereof. In embodiments, on an interconnected set of LANs, including those based on differing architectures and protocols, a router may act as a link between LANs, enabling messages to be sent from one to another.

Also, in some embodiments, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, in some embodiments, remote computers and other related electronic devices could be remotely connected to either LANs or WANs via a modem and temporary telephone link. In essence, in some embodiments, network 105 includes any communication method by which information may travel between client devices 102-104, and servers 106 and 107.

Figure 2:
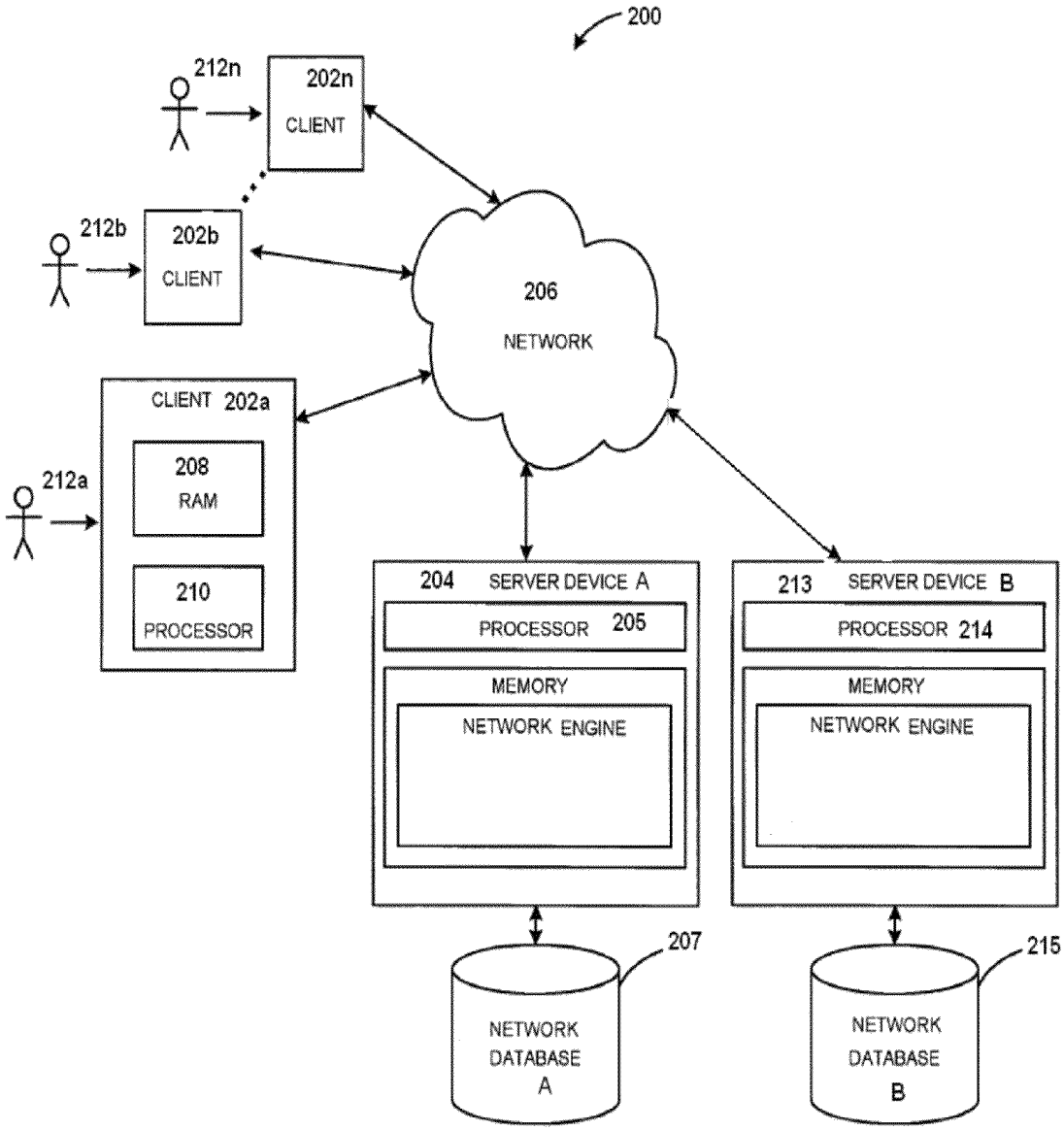
FIG. 2 illustrates features of some embodiments of the present invention.

FIG. 2 shows another exemplary embodiment of the computer/machine and network architecture that supports the inventive system for conducting a game. The member devices 202*a*, 202*b* thru 202*n* shown (e.g., lottery terminals, players' personal electronic devices) each at least includes a computer-readable medium, such as a random access memory (RAM) 208 coupled to a processor 210 or FLASH memory. The processor 210 may execute computer-executable program instructions stored in memory 208. Such processors comprise a microprocessor, an ASIC, and state machines. Such processors comprise, or may be in communication with, media, for example computer-readable media, which stores instructions that, when executed by the processor, cause the processor to perform the steps described herein. Embodiments of computer-readable media may include, but are not limited to, an electronic, optical, magnetic, or other storage or transmission device capable of providing a processor, such as the processor 210 of client 202*a*, with computer-readable instructions. Other examples of suitable media may include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. The instructions may comprise code from any computer-programming language, including, for example, C, C++, C#, Visual Basic, Java, Python, Perl, and JavaScript.

Member devices 202*a-n* may also comprise a number of external or internal devices such as a mouse, a CD-ROM, DVD, a keyboard, a display, or other input or output devices. Examples of client devices 202*a-n* may be personal computers, digital assistants, personal digital assistants, cellular phones, mobile phones, smart phones, pagers, digital tablets, laptop computers, Internet appliances, and other processor-based devices. In general, a client device 202*a* may be any type of processor-based platform that is connected to a network 206 and that interacts with one or more application programs. Client devices 202*a-n* may operate on any operating system capable of supporting a browser or browser-enabled application, such as Microsoft™, Windows™, or Linux. The client devices 202*a-n* shown may include, for example, personal computers executing a browser application program such as Microsoft Corporation's Internet Explorer™, Apple Computer, Inc.'s Safari™, Mozilla Firefox, and Opera. Through the client devices 202*a-n*, users (e.g. players, agents, etc.) 212*a-n* communicate over the network 206 with each other and with other systems and devices coupled to the network 206. As shown in FIG. 2, server devices 204 and 213 may be also coupled to the network 206.

In some embodiments, the term "mobile electronic device" may refer to any portable electronic device that may or may not be enabled with location tracking functionality. For example, a mobile electronic device can include, but is not limited to, a mobile phone, Personal Digital Assistant (PDA), Blackberry™, Pager, Smartphone, or any other reasonable mobile electronic device. For ease, at times the above variations are not listed or are only partially listed, this is in no way meant to be a limitation.

In some embodiments, the terms "proximity detection," "locating," "location data," "location information," and "location tracking" as used herein may refer to any form of location tracking technology or locating method that can be used to provide a location of a mobile electronic device, such as, but not limited to, at least one of location information manually input by a user, such as, but not limited to entering the city, town, municipality, zip code, area code, cross streets, or by any other reasonable entry to determine a geographical area; Global Positions Systems (GPS); GPS accessed using Bluetooth™; GPS accessed using any reasonable form of wireless and/or non-wireless communication; WiFi™ server location data; Bluetooth™ based location data; triangulation such as, but not limited to, network based triangulation, WiFi™ server information based triangulation, Bluetooth™ server information based triangulation; Cell Identification based triangulation, Enhanced Cell Identification based triangulation, Uplink-Time difference of arrival (U-TDOA) based triangulation, Time of arrival (TOA) based triangulation, Angle of arrival (AOA) based triangulation; techniques and systems using a geographic coordinate system such as, but not limited to, longitudinal and latitudinal based, geodesic height based, cartesian coordinates based; Radio Frequency Identification such as, but not limited to, Long range RFID, Short range RFID; using any form of RFID tag such as, but not limited to active RFID tags, passive RFID tags, battery assisted passive RFID tags; or any other reasonable way to determine location. For ease, at times the above variations are not listed or are only partially listed, this is in no way meant to be a limitation.

In some embodiments, the instant invention can utilize device that are enabled for NFC communications, which can represent a short-range wireless communications technology in which NFC-enabled devices are "swiped," "bumped," "tap" or otherwise moved in close proximity to communicate. In some embodiments, NFC could include a set of short-range wireless technologies, typically requiring a distance of 10 cm or less.

In some embodiment, NFC can operate at 13.56 MHz on ISO/IEC 18000-3 air interface and at rates ranging from 106 kbit/s to 424 kbit/s. In some embodiments, NFC can involve an initiator and a target; the initiator actively generates an RF field that can power a passive target. In some embodiment, this can enable NFC targets to take very simple form factors such as tags, stickers, key fobs, or cards that do not require batteries. In some embodiments, NFC peer-to-peer communication can be conducted when a plurality of NFC-enable device within close proximity of each other.

In some embodiments, NFC tags can contain data and be read-only or rewriteable. In some embodiment, NFC tags can be custom-encoded. In some embodiments, NFC tags and/or NFC-enabled device (e.g., smart phones with NFC capabilities) can securely store personal data such as debit and credit card information, loyalty program data, PINS and networking contacts, among other information.

In some embodiments, lottery data may also be communicated using any wireless means of communication, such as 4G, 3G, GSM, GPRS, WiFi, WiMax, and other remote local or remote wireless communication using information obtained via the interfacing of a wireless NFC enabled mobile device to a smart poster. In some embodiments, the term "wireless communications" includes communications conducted at ISO 14443 and ISO 18092 interfaces. In some embodiments, the communications between player's NFC-enabled smart device and lottery provided equipment (e.g., terminals, POS, POE, Hosts) is performed, for example, in accordance with the ISO 14443A/B standard and/or the ISO 18092 standard.

In some embodiments, player's NFC-enabled smart device and/or lottery provided equipment (e.g., terminals, POS, POE, Hosts) can include one or more additional transceivers (e.g., radio, Bluetooth, and/or WiFi transceivers) and associated antennas, and enabled to communicate with each other by way of one or more mobile and/or wireless protocols.

In some embodiments, NFC tags can include one or more integrated circuits.

In some embodiments, player's NFC-enabled smart device may include a cellular transceiver coupled to the processor and receiving a cellular network timing signal. In some embodiments, player's NFC-enabled smart device may further include a satellite positioning receiver coupled to the processor and receiving a satellite positioning system timing signal, and the processor may accordingly be configured to synchronize the internal timing signal to the satellite positioning system timing signal as the external timing signal. In some embodiments, the processor of player's NFC-enabled smart device may be configured to synchronize the internal timing signal to the common external system timing signal via the NFC circuit.

In some embodiments, player's NFC-enabled smart device may include a power source, an NFC circuit configured to wirelessly communicate using an NFC communications protocol, and a processor coupled to the power source and the NFC circuit. In some embodiments, the processor of player's NFC-enabled smart device may be configured to synchronize an internal timing signal to an external timing signal, cycle power to the NFC circuit to periodically switch the NFC circuit between a peer-to-peer recognition state and a low power state based upon the synchronized internal timing signal, and initiate peer-to-peer NFC communications with another NFC device when in range thereof and upon being simultaneously switched to the peer-to-peer recognition state therewith.

In some embodiments, player's NFC-enabled smart device may include a related physical computer-readable medium and may have computer-executable instructions for causing player's NFC-enabled smart device to initiating peer-to-peer NFC communications with another NFC device when in range thereof and upon being simultaneously switched to the peer-to-peer recognition state therewith.

In some embodiments, the processor of player's NFC-enabled smart device may be configured for communicating wireless voice and data via a cellular transceiver via a cellular communications network. By way of example, the data communications may include, but not limited to, email messages, Web data, etc. In some embodiments, player's NFC-enabled smart device may in addition (or instead) include other types of wireless communications circuits capable of transmitting voice or other data, such as a wireless LAN, WiMAX, etc., circuit. In some embodiments, the processor of player's NFC-enabled smart device may proceed directly to communicate with the trusted NFC device, and in the case of a "smart poster" NFC device (e.g., SLP/SLS), such as one configured to pass a Uniform Resource Locator (URL), the processor may automatically direct a browser application thereof to the URL without prompting for permission to proceed to the designated location.

Illustrative Examples for Conducting Games

Examples For Conducting Type 1 Games

In some embodiments, a bookmaker can give player(s), either at retail or over the internet, the opportunity to bet that a selection (an outcome of a future event) will not be verified. For purposes of this description, the use of term "verified" or "verify" with respect to an outcome of a future event means that it will be know in the future that the outcome has occurred. In some embodiments, the betting that the outcome will not be verified means placing a bet that particular event(s) will not occur (or will not become true). For purposes of this description, bets on outcomes that even(s) will not occur (or will not become true) are called herein as "Contra" bets.

In some embodiments, player(s) is/are explicitly provided with an option to play the Contra game and place a Contra bet in place of the bet offered by the bookmaker. In some embodiments, the odds for this selection will be determined by an algorithm on the basis of odds of the possible selections/outcomes of event(s), and can be calculated during the time of the bet acceptance or can be calculated in advance.

In some embodiments, the instant invention allows to offer additional betting options to the player and increase interest in the game. Fore example, using "Contra" bets, the available options for betting can be doubled.

In some embodiments, the instant invention can apply for betting for all event(s)/market(s) that have three or more possible selections/outcomes.

In some embodiments, the instant invention can calculate odds as follows.

a. For every individual bet offered the odds O are calculated as a function of the probability P that the outcome of the bet will be verified (i.e. will come out true) and the bookmaker's profit margin G. So $O=f(P,G)$.

b. If P is the probability that an outcome will come out true, then the probability for this outcome NOT to come out true is $1-P$.

c. From a and b, it follows that if for a bet the odds offered are $O=f(P,G)$ where P is the probability of the outcome to come out true, then for a counter bet (CONTRA) of that bet, the odds $O'=f(1-P,G)$.

Illustrative Examples of Games with the Contra Bets

Figure 4:
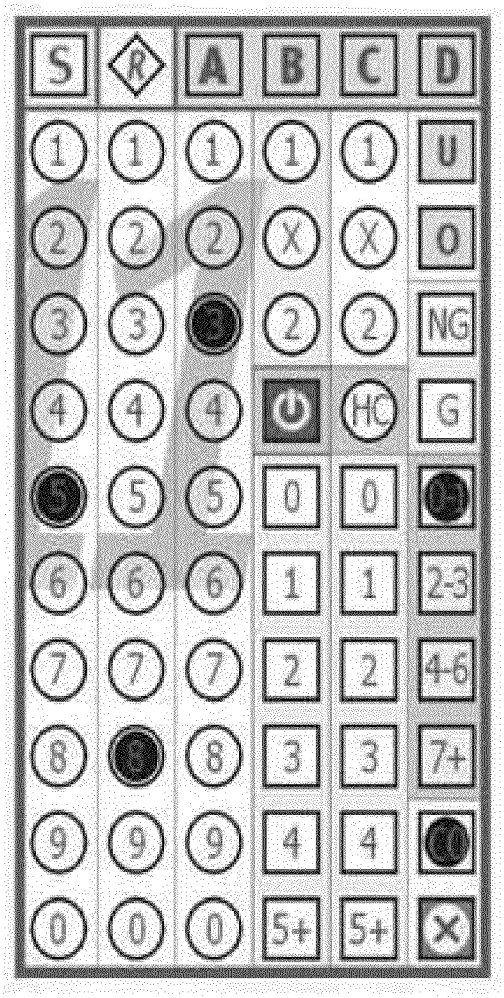
FIG. 4 illustrates features of some embodiments of the present invention.
Figures 5A, 5B:
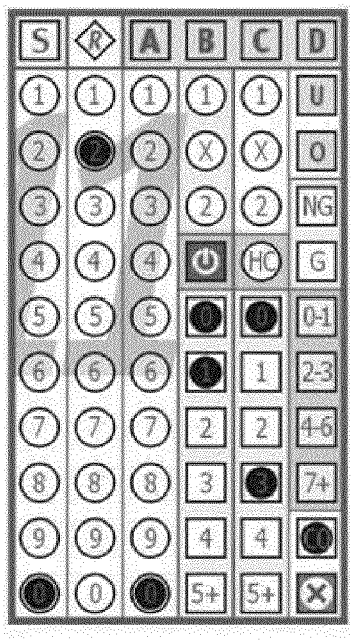
FIG. 5A illustrates features of some embodiments of the present invention.
FIG. 5B illustrates features of some embodiments of the present invention.
Figure 5D:
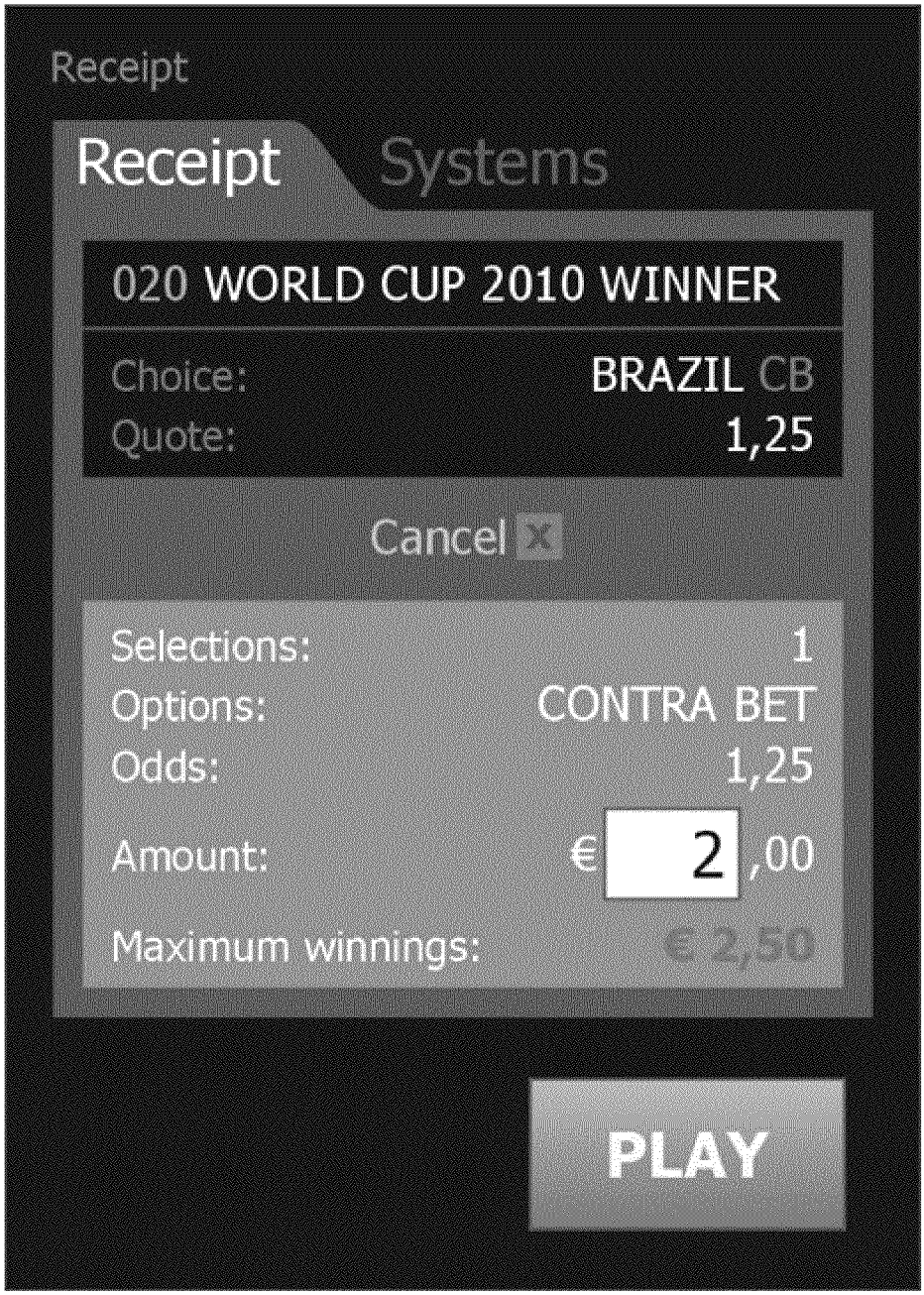
FIG. 5D illustrates features of some embodiments of the present invention.

1. In a soccer match, typically, the market/event "Sum of Goals" (i.e. total goals scored in the match, offered in selectable ranges of number of goals) can be offered with the following selections: "0-1", "2-3' and "4 and above". In a game with Contra bets, as shown in FIG. 3, player(s) can bet on one or more of 3 additional selections/outcomes: "not 0-1", "not 2-3", "not 4 and above." In some embodiments, as shown in FIG. 4, player(s) can select a match 583 (Blackburn—Newcastle) from the betting program and bet on the betting slip that a sum of goals for this match will NOT be "0-1" (by marking "CO" box).

2. In the soccer World Cup tournament, a market/event "Winner" is offered, to predict (bet on) a team that will win the tournament. If Brazil is the favorite, with odds 3.50 to win, by playing the "Contra" game for this selection/outcome, a player can effectively bet on an additional selection, "Brazil will not win," with odds 1.25. In some embodiments, as shown in FIGS. 5A-5D, player(s) can select Brazil from the betting program (coded as 020-0103) and can bet on the betting slip that Brazil will NOT win the World Cup tournament (by marking "CO" box).

In some embodiment, the instant invention can, in real-time, calculate odds of the Contra bets based on a dynamically updating pool of already placed straight bets (regular bets that event will occur) and/or Contra bets from a plurality of players. In some embodiment, the instant invention can, in real-time, dynamically determine winning Contra bet(s) for a plurality of players. In some embodiment, the instant invention can, in real-time, dynamically distribute the payouts to a plurality of players.

Examples For Conducting Type 2 Games

In some embodiments, the instant invention can allow player(s) to construct their own bet by compiling a non-exhaustive list of multiple alternative outcomes from a list of mutually exclusive alternative outcomes of a single event. In some embodiments, player(s) win(s) if any one of the selected alternative outcomes occurs and/or comes to be true.

In some embodiments, if the bet selected by the player's is verified, the player wins the amount he has bet, multiplied with the odds of his selection. In some embodiments, if the player's selection is not verified, the player loses.

In some embodiments, the betting opportunities can be unified into groups, where a specific number of these selections can be verified. These groups constitute individual betting games and are called "markets". More than one market can be offered for the same betting event.

Example of a selection (betting opportunity): The home team to win in a specific match.

Example of a market: The final result of a specific match, where only one of the three possible selections (home team win, draw, away team win) would be verified i.e. an exhaustive or non-exhaustive list of possible mutually exclusive outcomes.

Market Types

In a specific market, all the possible selections can be offered; in this case, the market is called "exhaustive". If not all of the possible selections are offered, then the market is called "non-exhaustive".

In some embodiments, markets that can be offered in lottery setting through, for example, printed games. In some embodiments, markets that can be offered electronically (e.g., over the internet) on computer and/or portable smart device. In some embodiments, the instant invention can offer player(s) to bet on, for example, over 100 markets/events or more.

In some embodiments, the instant invention can be utilized in betting exchanges.

Typically, in betting exchanges, players can match bets between them. The mechanics of this matching is, typically, as follows:

1) A player can state that a selection will be verified and thus ask for ("back") specific odds for a specific betting amount.

2) A player can state that a selection will not be verified and offer ("lay") specific odds for a specific betting amount.

3) If two players have a different opinion regarding the outcome of a selection and agree on the odds, then their bets are matched.

For example, for a market that is a result of a football match, a player can lay the "home win" selection at 1.47 while another can ask to back it at 1.48. In such case, there is no match. But if a player wants to back it at 1.47 or to lay it at 1.48, then there would be a match with the existing offer.

In some embodiments, player(s) can bet at the same time for the same event/market on two or more mutually exclusive outcomes of which only one would be, by definition, possible to come true and win if one of these outcomes is verified—such bets, for purposes of the present disclosure, are called MULTICHANCE bets. In some embodiments, the odds for this bet are determined by an algorithm that takes into account the probability of each for the selected outcomes to come true. In some embodiments, player(s) can create own bet(s) by grouping different selections/outcomes and taking specific odds for that. In some embodiments, only the player's fantasy can limit the betting opportunities offered.

In some embodiments, the instant invention can be applied both in the retail network (printed lotteries) and electronically, for all markets that have three or more possible outcomes regardless if all (exhaustive market) or some (non exhaustive market) are offered by the bookmaker. Player(s) cannot select all possible outcomes as it is certain that one of the selections will be verified.

Examples of Odds Calculation

In some embodiments, the odds for the player's selection (selected outcome) can determined at the moment of placing the bet and are related to the probability of each individual selected outcome coming true.

In some embodiments, in a MULTICHANCE bet, player (s) can bet on combination of mutually exclusive results (R1, R2 , . . . , RN) of a single event. For example, assuming the probability for each result R1, R2, . . . , RN is P1, P2, . . . , PN respectively; then the probability for any one of R1, R2, . . . RM to come true is P1+P2+ . . . +PM. And, where M=N the probability is 1 (i.e. it is certain that one of the probable results will come true and the bet cannot be placed).

The odds O offered for a result are a function of the probability P that this result will come true and the bookmaker's margin G—i.e., O=f(P, G), then the odds offered for a MULTICHANCE bet where the player selects M mutually exclusive probable results of an event are O'=f(P1+P2+ . . . +PM, G).

For example, in a single roll of one dice, the probability of each individual result (1, 2, 3, 4, 5 or 6) is 1/6. (Note: In this case the probabilities of all possible results are equal, which is not usually the case in real life betting opportunities). The odds that would be offered for a bet that 3 would be the outcome of the roll would be O=f(1/6, G) and the same for any other of the six exclusive outcomes. A MULTICHANCE combination bet would, for example, be that any of 3 or 4 or 6 would be the result of that single roll of the one dice. In that case the odds O' to be offered would be O'=f(1/6+1/6+1/6, G). Consequently, the odds offered for the MULTICHANCE bet, whose individual outcomes are mutually exclusive (as they are different possible outcomes of the same event), are a function of the sum of the probabilities of each outcome O'=f(P1+P2+ . . . +PM, G).

Illustrative Examples of Games with the MULTICHANCE Bets

Figure 7:
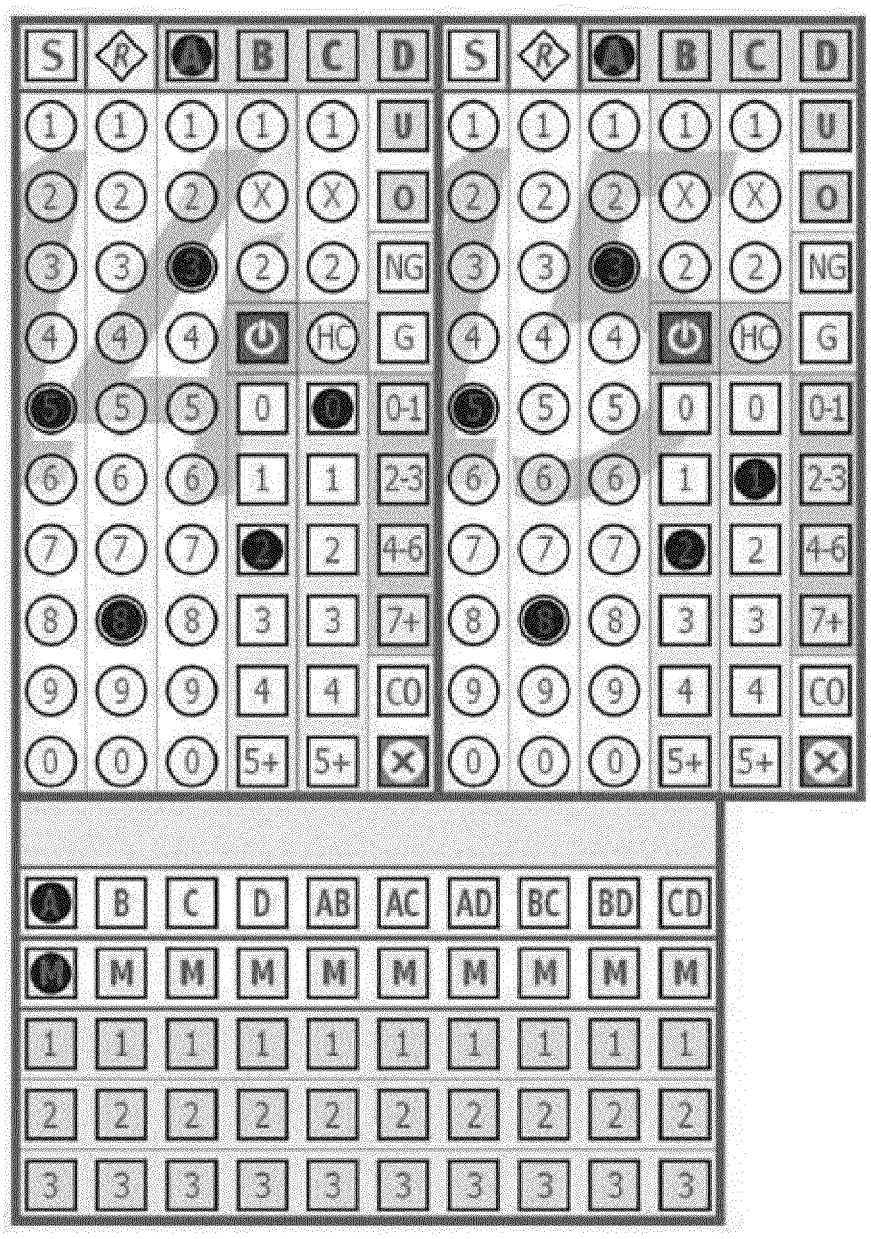
FIG. 7 illustrates features of some embodiments of the present invention.
Figure 8B:
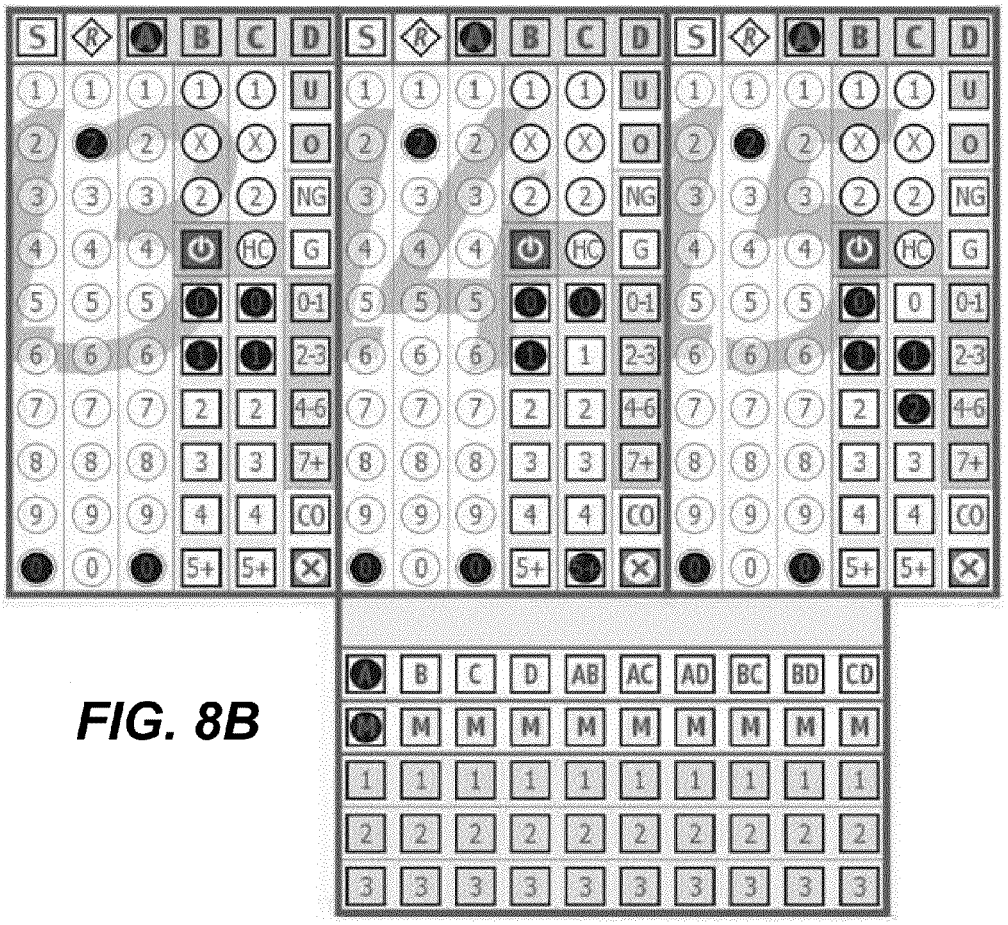
FIG. 8B illustrates features of some embodiments of the present invention.
Figure 8C:
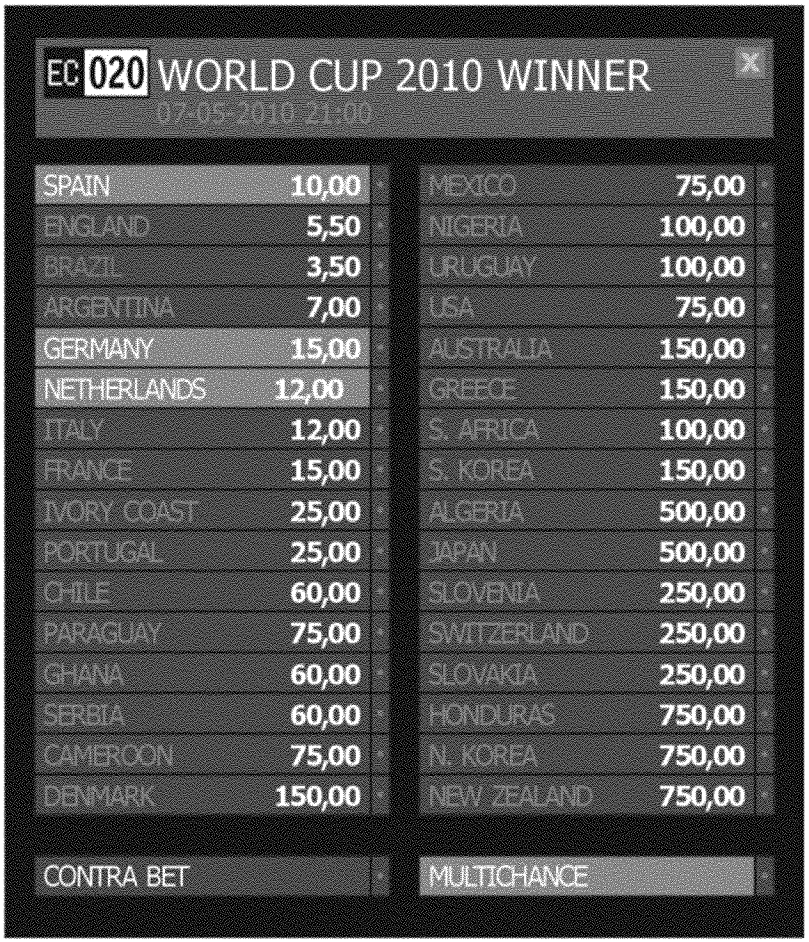
FIG. 8C illustrates features of some embodiments of the present invention.
Figure 8D:
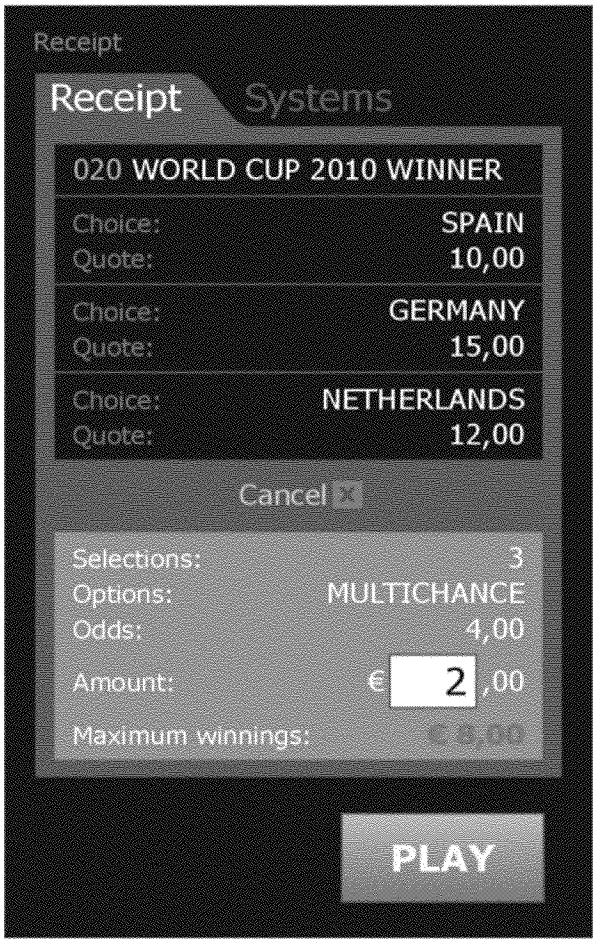
FIG. 8D illustrates features of some embodiments of the present invention.

1. In a football match, as shown in FIG. 6, a market "Correct Score" is offered for player(s) to predict (bet on) a correct final score. If "2-0" is offered with odds 8.00 and "2-1" is offered with odds 12.00 the player can select the MULTICHANCE bet of both with odds 4.80. If the outcome comes up as 2-0 or 2-1 the player wins and is paid his stake multiplied by 4.80. For all other results the player looses. In some embodiments, as shown in FIG. 7, the player can select a match 583 (Blackburn—Newcastle) from the betting program, can bet on the betting slip that the correct score of this match will be "2-0" or "2-1" and can select the MULTICHANCE (by marking "M" box) of these two correct scores.

2. In the soccer World Cup tournament, the market "Winner" is offered to predict (bet on) the team that will win the tournament. If, for example, Spain is offered at odds 10.00, Germany at 15.00 and Netherlands at 12.00, a player can select the MULTICHANCE bet of all of the above selections with odds 4.00. In some embodiments, as shown in FIGS. 8A-8D, player(s) can select Spain, Germany and Netherlands from the betting program (coded as 020-0101, 020-0105 and 020-0112 respectively), bets on the betting slip that these countries will win the tournament and can select the MULTICHANCE bet to bet that either one of these 3 countries will win the tournament (by marking a "M" box).

In some embodiment, the instant invention can, in real-time, calculate odds of the MULTICHANCE bets based on a dynamically updating pool of already placed straight bets (regular bets that event will occur) and/or MULTICHANCE bets from a plurality of players. In some embodiment, the instant invention can, in real-time, dynamically determine winning MULTICHANCE bet(s) for a plurality of players. In some embodiment, the instant invention can, in real-time, dynamically distribute the payouts to a plurality of players.

Examples for Conducting Type 3 Games

In some embodiments, the instant invention can allow to combine within a single offering/game both Contra and MULTICHANCE bets in accordance with principles of the instant invention discussed above.

In some embodiments, the invention is a computer-implemented method, that includes specifically programming at least one computer machine to at least perform the following steps:

In some embodiments, the method includes providing a plurality of game slips to game players, wherein each of the plurality of games slips has a plurality of game options, wherein a first game option of the plurality of game options includes a non-verified outcome of a first event, and wherein the non-verified outcome of the first event is an outcome that will not occur in a future.

In some embodiments, the method includes receiving the plurality of game slips from the game players, wherein the plurality of game slips comprise a plurality of selected game options and wherein at least one of the plurality of selected game options includes the first game option.

In some embodiments, the method includes determining odds of the first game option based, at least in part, on i) 1-P, wherein P is a probability of a verified outcome of the first event and wherein the verified outcome of the first event is an outcome that will occur in the future; ii) a financial criterion associated with a game provider; and iii) the plurality of selected game options.

In some embodiments, the method includes providing the odds to the game players that selected the first game option.

In some embodiments, the method includes receiving acceptance of the odds from the game players that selected the first game option.

In some embodiments, the method includes determining whether the first event has resulted in the verified outcome or the non-verified outcome; and In some embodiments, the method includes determining, for each game player of the game players that selected the first game option, at least one prize based, at least in part, on the odds accepted by each game player when the first event has resulted in the non-verified outcome.

In some embodiments, the game is a lottery game. In some embodiments, the method further includes displaying the plurality of game slips on a computer screen to the game players. In some embodiments, the method further includes distributing the at least one prize to each of the game players that selected the first game option. In some embodiments, the financial criterion associated with the game provider is a profit of the game provider.

In some embodiments, the invention is a computer-implemented method, that includes specifically programming at least one computer machine to at least perform the following steps:

In some embodiments, the method includes providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, and wherein the first game option and the second game option are mutually exclusive.

In some embodiments, the method includes receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the method includes determining odds of the first game option and second game option based, at least in part, on: i) P1+P2, wherein P2 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the method includes providing the odds to the first game player.

In some embodiments, the method includes receiving acceptance of the odds from the first game player.

In some embodiments, the method includes determining a third outcome of the first event, wherein the third outcome is a result of the first event.

In some embodiments, the method includes determining whether the third outcome of the first event matches the first outcome of the first game option or the second outcome of the second game option.

In some embodiments, the method includes determining at least one prize for the first game player based, at least in part, on the odds when the third outcome of the first event matches the first outcome of the first game option or the second outcome of the second game option.

In some embodiments, the game is a lottery game. In some embodiments, the method further includes displaying the plurality of game slips on a computer screen to the game players. In some embodiments, the method further includes distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a computer-implemented method, that includes specifically programming at least one computer machine to at least perform the following steps:

In some embodiments, the method includes providing a plurality of game slips to game players, wherein each of the plurality of games slips has a plurality of game options, wherein a first game option of the plurality of game options includes a non-verified outcome of a first event, wherein the non-verified outcome of the first event is an outcome that will not occur in a future, wherein a second game option of the plurality of game options includes a verified outcome of the first event, and wherein the verified outcome of the first event is an outcome that will occur in a future.

In some embodiments, the method includes receiving the plurality of game slips from the game players, wherein the plurality of game slips comprise a plurality of selected game options, wherein a first selected game option is the first game option, and wherein a second selected game option is the second game option.

In some embodiments, the method includes receiving first odds for the first selected game option.

In some embodiments, the method includes receiving second odds for the second selected game option.

In some embodiments, the method includes comparing the first odds to the second odds.

In some embodiments, the method includes matching the first selected game option with the second selected game option if the first odds and the second odds are equal.

In some embodiments, the method includes determining whether the first event has resulted in the verified outcome or the non-verified outcome.

In some embodiments, the method includes determining, for each game player of the game players that selected the first game option, at least one first prize based, at least in part, on the odds accepted by each game player when the first event has resulted in the non-verified outcome.

In some embodiments, the method includes determining, for each game player of the game players that selected the second game option, at least one second prize based, at least in part, on the odds accepted by each game player when the first event has resulted in the verified outcome.

In some embodiments, the game is a lottery game. In some embodiments, the method further includes displaying the plurality of game slips on a computer screen to the game players. In some embodiments, the method further includes distributing the first prize to each game player of the game players that selected the first game option if the first event has resulted in the non-verified outcome and distributing the second prize to each game player of the game players that selected the second game option if the second event has resulted in the verified outcome. In some embodiments, the financial criterion associated with the game provider is a profit of the game provider.

In some embodiments, the invention is a computer-implemented method, that includes specifically programming at least one computer machine to at least perform the following steps:

In some embodiments, the method includes providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, wherein the first game option and the second game option are mutually exclusive, wherein the first game option includes a non-verified first outcome of the first event, and wherein the non-verified first outcome of the first event is an outcome that will not occur in the future.

In some embodiments, the method includes receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the method includes determining odds of the first game option and second game option based, at least in part, on i) (1-P1)+P2, wherein P1 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the method includes providing the odds to the first game player.

In some embodiments, the method includes receiving acceptance of the odds from the first game player.

In some embodiments, the method includes determining a third outcome of the first event, wherein the third outcome is a result of the first event.

In some embodiments, the method includes determining whether the third outcome of the first event has resulted in the non-verified first outcome of the first game option.

In some embodiments, the method includes determining whether the third outcome of the first event matches the second outcome of the second game option.

In some embodiments, the method includes determining at least one prize for the first game player based, at least in part, on the odds when the third outcome of the first event results in the non-verified first outcome or the third outcome matches the second outcome of the second game option.

In some embodiments, the game is a lottery game. In some embodiments, the method further includes displaying the plurality of game slips on a computer screen to the game players. In some embodiments, the method further includes distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a computer-implemented method, that includes specifically programming at least one computer machine to at least perform the following steps:

In some embodiments, the method includes providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, wherein the first game option and the second game option are mutually exclusive, wherein the first game option includes a non-verified first outcome of the first event, wherein the second game option includes a non-verified second outcome of the first event and wherein each of the non-verified first outcome and the non-verified second outcome of the first event is an outcome that will not occur in the future.

In some embodiments, the method includes receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the method includes determining odds of the first game option and second game option based, at least in part, on i) (1-P1)+(1-P2), wherein P1 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the method includes providing the odds to the first game player.

In some embodiments, the method includes receiving acceptance of the odds from the first game player.

In some embodiments, the method includes determining a third outcome of the first event, wherein the third outcome is a result of the first event.

In some embodiments, the method includes determining whether the third outcome of the first event has resulted in the non-verified first outcome of the first game option.

In some embodiments, the method includes determining whether the third outcome of the first event has resulted in the non-verified second outcome of the second game option.

In some embodiments, the method includes determining at least one prize for the first game player based, at least in part, on the odds when the third outcome of the first event results in the non-verified first outcome of the first game option or the third outcome of the first event results in the non-verified second outcome of the second outcome of the second game option.

In some embodiments, the game is a lottery game. In some embodiments, the method further includes displaying the plurality of game slips on a computer screen to the game players. In some embodiments, the method further includes distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a non-verified outcome of a first event, and wherein the non-verified outcome of the first event is an outcome that will not occur in a future.

In some embodiments, the program code performs the step of receiving the plurality of game slips from the game players, wherein the plurality of game slips comprise a plurality of selected game options and wherein at least one of the plurality of selected game options includes the first game option.

In some embodiments, the program code performs the step of determining odds of the first game option based, at least in part, on i) 1-P, wherein P is a probability of a verified outcome of the first event and wherein the verified outcome of the first event is an outcome that will occur in the future; ii) a financial criterion associated with a game provider; and iii) the plurality of selected game options.

In some embodiments, the program code performs the step of providing the odds to the game players that selected the first game option.

In some embodiments, the program code performs the step of receiving acceptance of the odds from the game players that selected the first game option.

In some embodiments, the program code performs the step of determining whether the first event has resulted in the verified outcome or the non-verified outcome; and In some embodiments, the program code performs the step of determining, for each game player of the game players that selected the first game option, at least one prize based, at least in part, on the odds accepted by each game player when the first event has resulted in the non-verified outcome.

In some embodiments, the game is a lottery game. In some embodiments, the program code performs the step of further includes displaying the plurality of game slips on a computer screen to the game players. In some embodiments, the program code performs the step of distributing the at least one prize to each of the game players that selected the first game option. In some embodiments, the financial criterion associated with the game provider is a profit of the game provider.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, and wherein the first game option and the second game option are mutually exclusive.

In some embodiments, the program code performs the step of receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the program code performs the step of determining odds of the first game option and second game option based, at least in part, on: i) P2+P2, wherein P2 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the program code performs the step of providing the odds to the first game player.

In some embodiments, the program code performs the step of receiving acceptance of the odds from the first game player.

In some embodiments, the program code performs the step of determining a third outcome of the first event, wherein the third outcome is a result of the first event.

In some embodiments, the program code performs the step of determining whether the third outcome of the first event matches the first outcome of the first game option or the second outcome of the second game option.

In some embodiments, the program code performs the step of determining at least one prize for the first game player based, at least in part, on the odds when the third outcome of the first event matches the first outcome of the first game option or the second outcome of the second game option.

In some embodiments, the game is a lottery game. In some embodiments, the program code performs the step of displaying the plurality of game slips on a computer screen to the game players. In some embodiments, the program code performs the step of distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a non-verified outcome of a first event, wherein the non-verified outcome of the first event is an outcome that will not occur in a future, wherein a second game option of the plurality of game options includes a verified outcome of the first event, and wherein the verified outcome of the first event is an outcome that will occur in a future.

In some embodiments, the program code performs the step of receiving the plurality of game slips from the game players, wherein the plurality of game slips comprise a plurality of selected game options, wherein a first selected game option is the first game option, and wherein a second selected game option is the second game option.

In some embodiments, the program code performs the step of receiving first odds for the first selected game option.

In some embodiments, the program code performs the step of receiving second odds for the second selected game option.

In some embodiments, the program code performs the step of comparing the first odds to the second odds.

In some embodiments, the program code performs the step of matching the first selected game option with the second selected game option if the first odds and the second odds are equal.

In some embodiments, the program code performs the step of determining whether the first event has resulted in the verified outcome or the non-verified outcome.

In some embodiments, the program code performs the step of determining, for each game player of the game players that selected the first game option, at least one first prize based, at least in part, on the odds accepted by each game player when the first event has resulted in the non-verified outcome.

In some embodiments, the program code performs the step of determining, for each game player of the game players that selected the second game option, at least one second prize based, at least in part, on the odds accepted by each game player when the first event has resulted in the verified outcome.

In some embodiments, the game is a lottery game. In some embodiments, the program code performs the step of displaying the plurality of game slips on a computer screen to the game players. In some embodiments, the program code performs the step of distributing the first prize to each game player of the game players that selected the first game option if the first event has resulted in the non-verified outcome and distributing the second prize to each game player of the game players that selected the second game option if the second event has resulted in the verified outcome. In some embodiments, the financial criterion associated with the game provider is a profit of the game provider.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, wherein the first game option and the second game option are mutually exclusive, wherein the first game option includes a non-verified first outcome of the first event, and wherein the non-verified first outcome of the first event is an outcome that will not occur in the future.

In some embodiments, the program code performs the step of receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the program code performs the step of determining odds of the first game option and second game option based, at least in part, on i) (1-P1)+P2, wherein P1 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the program code performs the step of providing the odds to the first game player.

In some embodiments, the program code performs the step of receiving acceptance of the odds from the first game player.

In some embodiments, the program code performs the step of determining a third outcome of the first event, wherein the third outcome is a result of the first event.

In some embodiments, the program code performs the step of determining whether the third outcome of the first event has resulted in the non-verified first outcome of the first game option.

In some embodiments, the program code performs the step of determining whether the third outcome of the first event matches the second outcome of the second game option.

In some embodiments, the program code performs the step of determining at least one prize for the first game player based, at least in part, on the odds when the third outcome of the first event results in the non-verified first outcome or the third outcome matches the second outcome of the second game option.

In some embodiments, the game is a lottery game. In some embodiments, the program code performs the step of displaying the plurality of game slips on a computer screen to the game players. In some embodiments, the program code performs the step of distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

In some embodiments, the invention is a specifically programmed computer system that includes a non-transient computer memory having at least one region for storing computer executable program code; and at least one processor for executing the program code stored in the memory, wherein the program code performs at least the following steps:

In some embodiments, the program code performs the step of providing a plurality of game slips to game players, wherein each of the plurality of games slips has a plurality of game options, wherein a first game option of the plurality of game options includes a first outcome of a first event in at least one market, wherein a second game option of the plurality of game options includes a second outcome of the first event in the at least one market, wherein the at least one market is a plurality of alternative outcomes of the first event, wherein the first game option and the second game option are mutually exclusive, wherein the first game option includes a non-verified first outcome of the first event, wherein the second game option includes a non-verified second outcome of the first event and wherein each of the non-verified first outcome and the non-verified second outcome of the first event is an outcome that will not occur in the future.

In some embodiments, the program code performs the step of receiving the plurality of game slips from the game players, wherein the plurality of game slips comprise a plurality of selected game options, wherein at least one of the plurality of selected game options from a first game player includes the first game option, and wherein at least one of the plurality of selected game option from the first game player includes the second game option.

In some embodiments, the program code performs the step of determining odds of the first game option and second game option based, at least in part, on i) (1-P1)+(1-P2), wherein P1 is a probability that the first outcome of the first event included in the first game option will be verified, wherein P2 is a probability that the second outcome of the first event included in the second game option will be verified, and wherein the verified outcome of the first event is an outcome that will occur in the future; ii) a financial criterion associated with a game provider; and iii) the plurality of selected game options.

In some embodiments, the program code performs the step of providing the odds to the first game player.

In some embodiments, the program code performs the step of receiving acceptance of the odds from the first game player.

In some embodiments, the program code performs the step of determining a third outcome of the first event, wherein the third outcome is a result of the first event.

In some embodiments, the program code performs the step of determining whether the third outcome of the first event has resulted in the non-verified first outcome of the first game option.

In some embodiments, the program code performs the step of determining whether the third outcome of the first event has resulted in the non-verified second outcome of the second game option.

In some embodiments, the program code performs the step of determining at least one prize for the first game player based, at least in part, on the odds when the third outcome of the first event results in the non-verified first outcome of the first game option or the third outcome of the first event results in the non-verified second outcome of the second outcome of the second game option.

In some embodiments, the game is a lottery game. In some embodiments, the program code performs the step of displaying the plurality of game slips on a computer screen to the game players. In some embodiments, the program code performs the step of distributing the at least one prize to the first game player. In some embodiments, the financial criterion associated with the game provider is a profit of the game provider.

In some embodiments, the market is a non-exhaustive market and the non-exhaustive market is a market that includes less than all possible alternative outcomes of the first event. In some embodiments, the market is an exhaustive market and the exhaustive market is a market that includes all possible alternative outcomes of the first event.

While a number of embodiments of the present invention have been described, it is understood that these embodiments are illustrative only, and not restrictive, and that many modifications may become apparent to those of ordinary skill in the art.

The invention claimed is:

1. A game-operating computer-implemented method, comprising:

concurrently receiving, via a computer network, by a at least one game-operating computer processor associated with a game provider, a plurality of Contra bets from a plurality of game players;

wherein the plurality of Contra bets cover at least 100 events;

wherein each event can have three or more possible outcomes;

wherein each Contra bet comprises a combination of a first bet selecting a non-verified outcome of a particular event and a second bet selecting at least one possible verified outcome of the particular event;

wherein the non-verified outcome is an outcome that the particular event will not occur in the future;

wherein the at least one possible verified outcome is an outcome that may occur when the particular event occurs in the future;

continuously updating, in real-time, by the at least one game-operating computer processor, an in-real-time dynamically-updated pool of already placed bets, comprising:

a plurality of already placed Contra bets;

dynamically and concurrently determining, by the at least one game-operating computer processor, odds for each Contra bet based, at least in part, on:

(i)P, (ii) 1-P, wherein P is a probability of the at least one possible verified outcome of the particular event;

wherein 1-P is a probability of the non-verified outcome of the particular event;

(iii) at least one financial criterion associated with the game provider; and (iv) the in-real-time dynamically-updated pool of already placed bets;

electronically and concurrently outputting, by the at least one game-operating computer processor, the odds for each Contra bet;

electronically and concurrently receiving, by the at least one game-operating computer processor, indications of payments for the plurality of Contra bets, wherein an amount of each payment is based on the odds;

electronically determining, by the at least one game-operating computer processor, each winning Contra bet, wherein a particular Contra bet is a winning Contra bet when one of the following occurs:

1) the particular event does not occur, or 2) the at least one possible verified outcome of the particular event occurs;

electronically determining, by the at least one game-operating computer processor, a payout amount for each winning Contra bet; and electronically causing, by the at least one game-operating computer processor, to distribute the payout amount to a corresponding game player of the plurality of game players.

2. The method of claim 1, wherein the plurality of Contra bets are related to a lottery game.

3. The method of claim 1, wherein the financial criterion associated with the game provider is a profit of the game provider.

4. A game-operating computer-implemented method, comprising:

concurrently receiving, via a computer network, by a at least one game-operating computer processor associated with a game provider, a plurality of Multichance bets from a plurality of game players;

wherein the plurality of Multichance bets cover at least 100 events;

wherein each event can have two or more possible outcomes;

wherein each Multichance bet comprises a combination of a first bet selecting at least one first possible outcome of a particular event and a second bet selecting at least one second possible outcome of the particular event;

wherein the at least one first possible outcome and the at least one second possible outcome are mutually exclusive;

continuously updating, in real-time, by the at least one game-operating computer processor, an in-real-time dynamically-updated pool of already placed bets, comprising:

a plurality of already placed Multichance bets;

dynamically and concurrently determining, by the at least one game-operating computer processor, odds for each Multichance bet based, at least in part, on:

i)P1 +P2 wherein P1 is a probability that the at least one first possible outcome of the particular event, wherein P2 is a probability that the at least one second possible outcome of the particular event;

ii) at least one financial criterion associated with a game provider; and iii) the in-real-time dynamically-updated pool of already placed bets;

electronically and concurrently outputting, by the at least one game-operating computer processor, the odds for each Multichance bet;

electronically and concurrently receiving, by the at least one game-operating computer processor, indications of payments for the plurality of Multichance bets, wherein an amount of each payment is based on the odds;

electronically determining, by the at least one game-operating computer processor, each winning Multichance bet, wherein a particular Multichance bet is a winning Multichance bet when the at least one first possible outcome of the particular event occurs or the at least one second possible outcome of the particular event occurs;

electronically determining, by the at least one game-operating computer processor, a payout amount for each winning Multichance bet; and electronically causing, by the at least one game-operating computer processor, to distribute the payout amount to a corresponding game player of the plurality of game players.

5. The method of claim 4, wherein the plurality of Multichance bets are related to a lottery game.

6. The method of claim 4, wherein the financial criterion associated with the game provider is a profit of the game provider.

7. The method of claim 4, wherein the at least one first possible outcome of the particular event and the at least one second possible outcome of the particular event define a non-exhaustive market and wherein the non-exhaustive market is a market that includes less than all possible outcomes of the particular event.

8. The method of claim 4, wherein the at least one first possible outcome of the particular event and the at least one second possible outcome of the particular event define an exhaustive market and wherein the exhaustive market is a market that includes all possible outcomes of the particular event.

9. A specifically programmed game-operating computer system, comprising:

a non-transient computer memory having at least one region for storing computer executable game-operating program code; and at least one processor for executing the game-operating program code stored in the memory, wherein, when executing the game-operating program code, the at least one processor performs at least the following:

concurrently receiving, via a computer network, a plurality of Contra bets from a plurality of game players;

wherein the plurality of Contra bets cover at least 100 events;

wherein each event can have three or more possible outcomes;

wherein each Contra bet comprises a combination of a first bet selecting a non-verified outcome of a particular event and a second bet selecting at least one possible verified outcome of the particular event;

wherein the non-verified outcome is an outcome that the particular event will not occur in the future;

wherein the at least one possible verified outcome is an outcome that may occur when the particular event occurs in the future;

continuously updating, in real-time, an in-real-time dynamically-updated pool of already placed bets, comprising:

a plurality of already placed Contra bets;

dynamically and concurrently determining odds for each Contra bet based, at least in part, on:

(i) P, (ii) 1-P, wherein P is a probability of the at least one possible verified outcome of the particular event;

wherein 1-P is a probability of the non-verified outcome of the particular event;

(iii) at least one financial criterion associated with a game provider; and (iv) the in-real-time dynamically-updated pool of already placed bets;

electronically and concurrently outputting the odds for each Contra bet;

electronically and concurrently receiving indications of payments for the plurality of Contra bets, wherein an amount of each payment is based on the odds;

electronically determining each winning Contra bet, wherein a particular Contra bet is a winning Contra bet when one of the following occurs:

1) the particular event does not occur, or 2) the at least one possible verified outcome of the particular event occurs electronically determining a payout amount for each winning Contra bet; and electronically causing to distribute the payout amount to a corresponding game player of the plurality of game players.

10. The system of claim 9, wherein the plurality of Contra bets are related to a lottery game.

11. The system of claim 9, wherein the financial criterion associated with the game provider is a profit of the game provider.

12. A specifically programmed game-operating computer system, comprising:

a non-transient computer memory having at least one region for storing computer executable game-operating program code; and at least one processor for executing the game-operating program code stored in the memory, wherein, when executing the game-operating program code, the at least one processor performs at least the following:

concurrently receiving, via a computer network, a plurality of Multichance bets from a plurality of game players;

wherein the plurality of Multichance bets cover at least 100 events;

wherein each event can have two or more possible outcomes;

wherein each Multichance bet comprises a combination of a first bet selecting at least one first possible outcome of a particular event and a second bet selecting at least one second possible outcome of the particular event;

wherein the at least one first possible outcome and the at least one second possible outcome are mutually exclusive;

continuously updating, in real-time, an in-real-time dynamically-updated pool of already placed bets, comprising:

a plurality of already placed Multichance bets;

dynamically and concurrently determining odds for each Multichance bet based, at least in part, on:

i)P1 +P2 wherein P1 is a probability that the at least one first possible outcome of the particular event, wherein P2 is a probability that the at least one second possible outcome of the particular event;

ii) at least one financial criterion associated with a game provider; and iii) the in-real-time dynamically-updated pool of already placed bets;

electronically and concurrently outputting the odds for each Multichance bet;

electronically and concurrently receiving indications of payments for the plurality of Multichance bets, wherein an amount of each payment is based on the odds;

electronically determining each winning Multichance bet, wherein a particular Multichance bet is a winning Multichance bet when the at least one first possible outcome of the particular event occurs or the at least one second possible outcome of the particular event occurs;

electronically determining a payout amount for each winning Multichance bet; and electronically causing, by the at least one game-operating computer processor, to distribute the payout amount to a corresponding game player of the plurality of game players.

13. The system of claim 12, wherein the plurality of Multichance bets are related to a lottery game.

14. The system of claim 12, wherein the financial criterion associated with the game provider is a profit of the game provider.

15. The system of claim 12, wherein the at least one first possible outcome of the particular event and the at least one second possible outcome of the particular event define a non-exhaustive market and wherein the non-exhaustive market is a market that includes less than all possible outcomes of the particular event.

16. The system of claim 12, wherein the at least one first possible outcome of the particular event and the at least one second possible outcome of the particular event define an exhaustive market and wherein the exhaustive market is a market that includes all possible outcomes of the particular event.

* * * * *